US007182015B2

(12) United States Patent
Young

(10) Patent No.: US 7,182,015 B2
(45) Date of Patent: Feb. 27, 2007

(54) MULTI-VARIABLE, MULTI-PARAMETER PROJECTILE LAUNCHING AND TESTING DEVICE

(76) Inventor: Li Young, 533 Stony Brook Dr., Bridgewater, NJ (US) 08807

( * ) Notice: Subject to any disclaimer, the term of this patent is extended or adjusted under 35 U.S.C. 154(b) by 139 days.

(21) Appl. No.: 10/884,738

(22) Filed: Jul. 2, 2004

(65) Prior Publication Data

US 2006/0000136 A1 Jan. 5, 2006

(51) Int. Cl.
*G01L 5/00* (2006.01)

(52) U.S. Cl. ..... 89/160; 89/1.12; 73/167

(58) Field of Classification Search ..... 89/160, 89/14.1, 1.12, 37.01; 73/167; 42/98
See application file for complete search history.

(56) References Cited

U.S. PATENT DOCUMENTS

| | | | | |
|---|---|---|---|---|
| 1,327,086 | A * | 1/1920 | Dawson et al. | 89/1.12 |
| 2,404,736 | A * | 7/1946 | Marick | 219/537 |
| 2,939,319 | A * | 6/1960 | Raymond et al. | 73/167 |
| 3,444,733 | A * | 5/1969 | Curchack | 73/167 |
| 3,597,969 | A * | 8/1971 | Curchack | 73/167 |
| 3,601,353 | A * | 8/1971 | Dale | 248/470 |
| 4,283,989 | A * | 8/1981 | Toulios et al. | 89/6.5 |
| 5,233,901 | A * | 8/1993 | Nilsson et al. | 89/6.5 |
| 5,684,264 | A | 11/1997 | Cassells et al. | |
| 5,988,647 | A | 11/1999 | Porter et al. | |
| 6,198,694 | B1 | 3/2001 | Kroling et al. | |
| 6,722,195 | B2 | 4/2004 | Duke | |
| 6,732,628 | B1 | 5/2004 | Coburn et al. | |
| 2006/0032288 | A1 * | 2/2006 | Correia et al. | 73/12.11 |

* cited by examiner

*Primary Examiner*—Michael J Carone
*Assistant Examiner*—Susan Alimenti
(74) *Attorney, Agent, or Firm*—Kenneth P. Glynn, Esq

(57) ABSTRACT

A multi-variable, multi-parameter projectile launching and testing device includes; a.) an elongated hollow acceleration tube having a firing end and an exit end; b.) firing mechanism functionally connected to the firing end of the elongated acceleration tube to create sufficient force to accelerate a projectile through the elongated acceleration tube; c.) a heating mechanism for temperature control of a projectile; d.) rotation means functionally connected to the elongated acceleration tube for rotating it; e.) a first control mechanism for variable control of the firing means; f.) a second control mechanism for variable control of the heating means; and, g.) a third control mechanism for variable control of the rotation mechanism. A user may accelerate a projectile through the elongated acceleration tube with a pre-selected force, at a pre-selected temperature and with a pre-selected rate of rotation using the first, the second and the third control mechanism.

10 Claims, 6 Drawing Sheets

MULTI-VARIABLE, MULTI-PARAMETER PROJECTILE LAUNCHING AND TESTING DEVICE

BACKGROUND OF THE INVENTION

1. Field of the Invention

The present invention relates to a new device for controlling and testing projectiles, especially bullets and other munitions. The device includes capabilities for varying and controlling the firing force (and hence, speed and momentum), the temperature and the rotation of the fired projectile.

2. Information Disclosure Statement

The following patents relate to the field of bullet testing:

U.S. Pat. No. 6,732,628B1 discloses a bullet trap for arresting and trapping a fired bullet. The bullet trap includes a primary enclosure having a shooting port and a plurality of discrete, resilient bullet trap media in the enclosure. In the preferred embodiment, the media are generally spherical and have a durometer less than or equal to about 100. The media is operable to arrest and capture a fired bullet in a sufficiently small enclosure so as to be portable.

U.S. Pat. No. 6,722,195B2 discloses a method and apparatus for trapping projectiles so that the projectiles are not damaged. An elongated trough is typically filled with alternating layers of a foam substance and a fibrous substance. Alternatively, the trough can be filled with just a foam or fibrous substance. A projectile launcher such as a gun is connected to the trough and a projectile is shot into the filling substance substantially parallel a longitudinal axis of the trough. The trough can be opened and the projectile can be recovered from the filling substance.

U.S. Pat. No. 6,198,694B1 discloses a method and a device for deciding relative to a chosen reference system, and without contact, the position, direction or speed-or any combination thereof-for a projectile in its flight through a gas towards a giver target, the position of the projectile in a first plane is decided at a certain distance from the target by means of at least three acoustic sensors arranged in a vicinity of the plane. Acoustic sound waves, emanating from a turbulent gas volume extending essentially straight behind the projectile and/or emanating from a wake or monopole existing essentially straight behind the projectile, are received by means of the acoustic sensors. Time differences for the arrival of the acoustic sound waves to the respective acoustic sensors are measured. The projectile position in the first plane is calculated from the time differences. The hit point of the projectile in a target plane through the target is decided with the help of the calculated projectile position in the first plane.

U.S. Pat. No. 5,988,647 discloses a projectile trap having three groups of suspended polyurethane sheets. The polyurethane sheets are processed so as to have high cut and tear resistance properties and low rebound properties. The hardness of the polyurethane sheets increases from the first group of sheets at the front of the bullet trap, which are first contacted by a bullet, to the third group of polyurethane sheets at the rear of the bullet trap. The polyurethane sheets are suspended in the bullet trap by a keying arrangement which ensures that individual polyurethane sheets of a particular group may only be placed at specific locations in the bullet trap.

U.S. Pat. No. 5,684,264 discloses a ballistic containment device for use in inspecting, loading and unloading firearms having an outer drum with a rim portion defining an open end, an inner wall surface and a closed end, together forming an outer chamber into which is suspended a semi-rigid kinetic energy absorptive member, which member is constructed from a plurality of layers of fabric woven from long chain synthetic polyamide fibre, which layers are bonded to one another by a non-rigid adhesive material. The kinetic energy absorptive member is suspended into the catchment member, from the rim portion as aforesaid, by means of a support web constructed of a plurality of overlapping straps of fabric woven from long chain synthetic polyamide fibre bonded to the kinetic energy absorptive member by means of the non-rigid adhesive material.

Notwithstanding the prior art, the present invention is neither taught nor rendered obvious thereby.

SUMMARY OF THE INVENTION

The present invention is directed to a multi-variable, multi-parameter projectile launching and testing device. It includes; a.) an elongated hollow acceleration tube having a firing end and an exit end; b.) firing means functionally connected to the firing end of the elongated acceleration tube, the firing means including a force-producing mechanism to create sufficient force to accelerate a projectile through the elongated acceleration tube; c.) heating means functionally connected to at least a portion of the elongated acceleration tube for temperature control of a projectile; d.) rotation means functionally connected to the elongated acceleration tube for rotating the acceleration tube; e.) first control means for variable control of the firing means; f.) second control means for variable control of the heating means; and, g.) third control means for variable control of the rotation means; wherein a user may accelerate a projectile through the elongated acceleration tube with a pre-selected force, at a pre-selected temperature and with a pre-selected rate of rotation using the first control means, the second control means and the third control means.

In preferred embodiments, the present invention multi-variable, multi-parameter projectile acceleration and testing further includes at least one microprocessor, and the first control means, the second control means, and the third control means are controlled with the microprocessor. In other embodiments, the present invention device includes a multi-variable, multi-parameter projectile acceleration and testing device wherein the microprocessor includes programmable software that will enable a user to pre-program the first control means, the second control means and the third control means. In some embodiments, there is a single microprocessor connected to the first control means, to the second control means, and to the third control means. In other embodiments of the present invention a multi-variable, multi-parameter projectile acceleration and testing device, there are three seperate microprocessors, one for each of the first control means, the second control means, and the third control means.

In some preferred embodiments of the present invention, there is an orientation altering means for changing orientation of a projectile accelerated form the elongated acceleration tube. This may change the orientation of the projectile, e.g. by tilting it, and/or tumbling and/or yawling.

In the present invention a multi-variable, multi-parameter projectile acceleration and testing device, the firing means may include a pneumatic firing mechanism, hydraulic firing mechanism, a mechanical firing mechanism, an explosive firing mechanism, a phase change firing mechanism, an expanding gas firing mechanism, or other equivalent rapid force-applying mechanism.

In some embodiments, the present invention multi-variable, multi-parameter projectile acceleration and testing device includes path altering means for changing a trajectory path of a projectile acceleration from the elongated acceleration tube.

In some embodiments, the present invention multi-variable, multi-parameter projectile acceleration and testing device includes a target support means that includes an adjustable height mechanism and a target holding mechanism.

In some embodiments, the present invention multi-variable, multi-parameter projectile acceleration and testing device target support means includes a target hanger for clothing or fabric.

In some embodiments, the present invention multi-variable, multi-parameter projectile acceleration and testing device heating means is selected from the group consisting of electric, gas, steam, heat pump, heat exchange, phase change or exothermic heating systems.

In some embodiments, the present invention multi-variable, multi-parameter projectile acceleration and testing device rotation means is selected from the group consisting of electromechanical, electromagnetic and turbine drive mechanism.

In some embodiments, the present invention multi-variable, multi-parameter projectile acceleration and testing device includes a bullet trap.

In some embodiments, the present invention multi-variable, multi-parameter projectile acceleration and testing device includes a vacuum assist mechanism connected to the elongated acceleration tube.

In this case, the elongated acceleration tube may include a projectile-penetrating sealing membrane.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
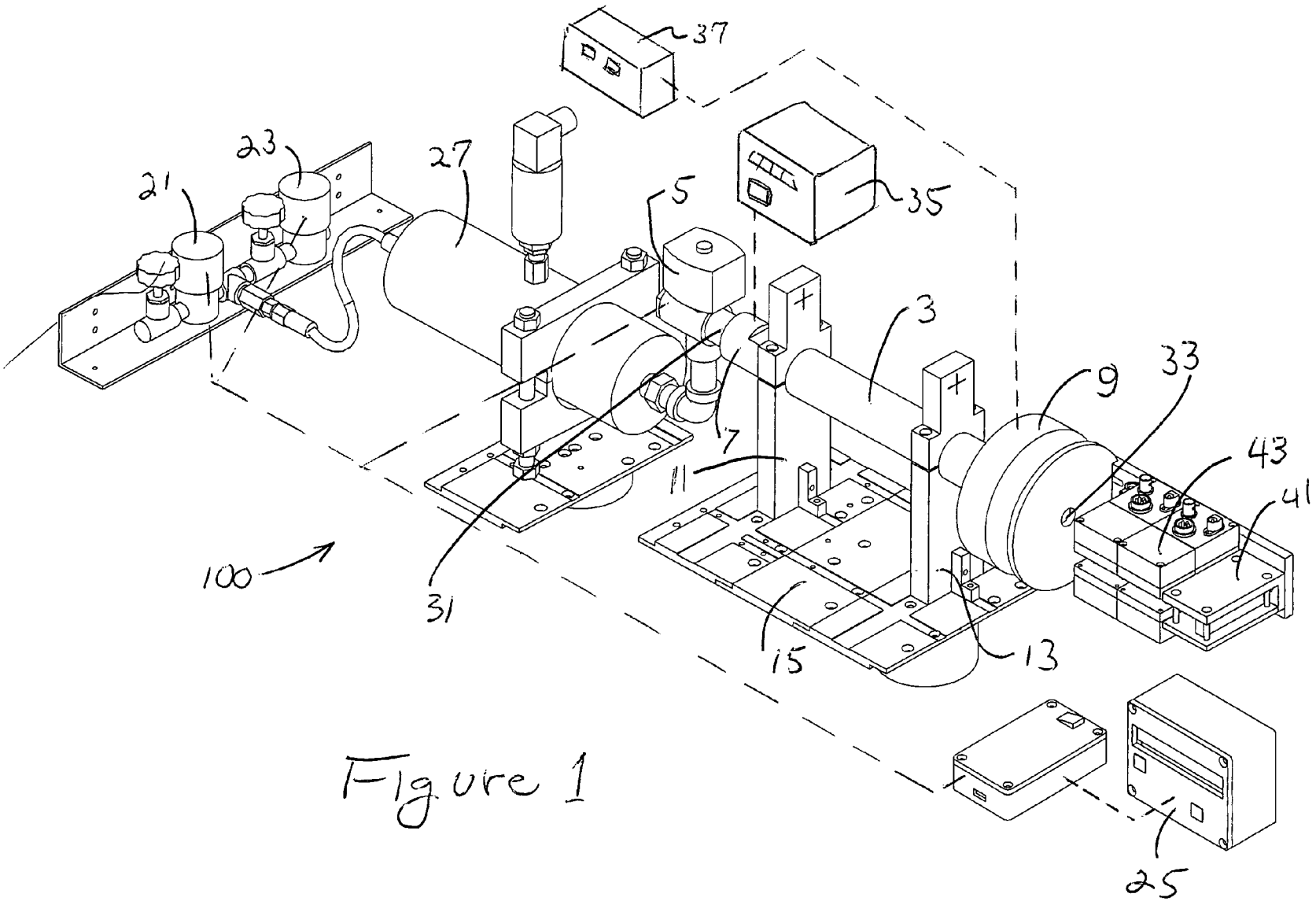
FIG. 1 shows an oblique front view of a multi-variable, multi-parameter projectile launching and testing device of the present invention.

FIG. 1 shows an oblique front view of a present invention a multi-variable, multi-parameter projectile launching and testing device 100. Device 100 includes an elongated hollow acceleration tube 3, a firing means 5, a heating means 7 and a rotation means 9. In this embodiment, elongated hollow acceleration tube 3 has an outer insulating tube and an inside rotating tube controlled by electromagnetic rotating means 9.

Elongated acceleration tube 3 is supported by brackets 11 and 13 mounted on base 15. Other supports, not shown, may be included. Heating means 7 is a thermal coil, but may be any heating means described. In this embodiment, firing means 5 has a pressurized gas based firing mechanism. Control valves 21 and 23 are connected to extremely high pressure tanks of inert gas. Control valves 21 and 23 are controlled by microprocessor 25 to allow sufficient gas to enter tank 27. The pressure of tank 27 determines the gaseous pressure force against a projectile such as a bullet when placed in the firing end 31 of elongated hollow acceleration tube 3. A bullet or other projectile is carefully pushed down elongated hollow acceleration tube 3 via an exit end 33. Microprocessor 25 controls firing valve 5 to release the pressurized gas in tank 27 to shoot (accelerate) the projectile prior to the projectile being fired, heating means 7 heats the projectile to a desired temperature via microprocessor controller 35. Also, microprocessor 37 may be set to control the spinning of elongated hollow acceleration tube 3 so as to simulate a spinning projectile caused by a typical rifle barrel or other firearm or armament.

In this embodiment, firing means 5 includes a pressure release valve that is the control means. Heating means 7 includes a variostat, transformer or other controller to adjust electrical current to control the heat. Similarly, rotation means 9 has a power controller (e.g. voltage controller) that affords variable rotational speeds. These control means are controlled by microprocessors 25, 35 and 37 respectively.

Orientation altering means 41 enables a user to reorient the projectile. It may also alter the trajectory path or both. Orientation is the spatial relationship of the projectile relative to how its front face is, forward, up, down, left, right or a combination. Trajectory path is independent of projectile orientation but defines the space displaced by the projectiles movement through space. Thus, a bullet could be "fired" in a straight line at a target or in a curved or deflected path at a target. Orientation would determine whether or not the bullet is flying towards the target nose first, sideways or crooked and/or tumbling and/or yawling. Detectors 43 may determine speed and trajectory of an exiting projectile.

Figure 2:
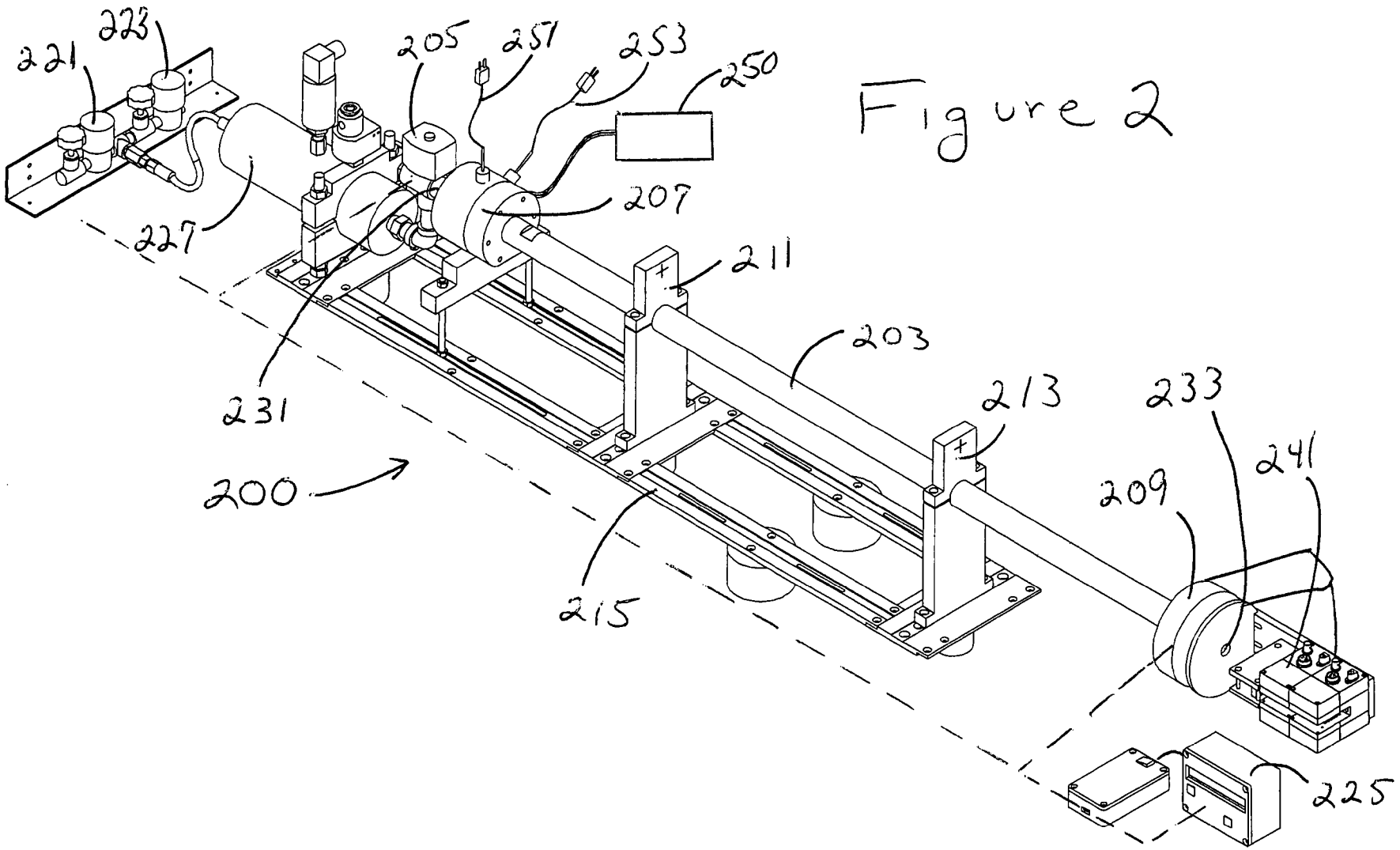
FIG. 2 illustrates an oblique front view of another embodiment of the present invention multi-variable, multi-parameter projectile launching and testing device.

FIG. 2 shows a front oblique view of another embodiment of a present invention device 200. Device 200 includes an elongated hollow acceleration tube 203, a firing means 205, a heating means 207 and a rotation means 209. In this embodiment, elongated hollow acceleration tube 203 has an outer insulating tube and an inside rotating tube controlled turbine blade powered motor 209.

Elongated acceleration tube 203 is supported by brackets 211 and 213 mounted on base 215. Other supports, not shown, may be included. Heating means 207 is a heat exchange device with heat exchanger 250 and with thermal couples 251 and 253, but may be any heating means described. In this embodiment, firing means 205 has a pressurized gas based firing mechanism. Control valves 221 and 223 are connected to hydraulic pressure secondary tanks of hydraulic fluids that are connected to primary hydraulic tank 227. Control valves 221 and 223 are controlled by microprocessor 225 to allow sufficient hydraulic fluid to enter tank 227 to accelerate a piston for firing. Also, microprocessor 225 controls firing means 205, heating means 207 as well as an inside rotating tube controlled turbine blade powered motor 209. The length of the piston and the piston speed determines the force against a projectile such as a bullet when placed in the firing end 231 of elongated hollow acceleration tube 203. A bullet or other projectile is carefully pushed down elongated hollow acceleration tube 203 via an exit end 233. Prior to the projectile being fired, heating means 207 heats the projectile to a desired temperature via microprocessor controller 225. Also, microprocessor 225 may be set to control the spinning of elongated hollow acceleration tube 203 so as to simulate a spinning projectile caused by a typical rifle barrel.

The embodiment described in FIGS. 1 and 2 above may be utilized to accelerate a projectile such as a bullet, shrapnel, a round, a dart or other small projectile at a predetermined temperature, force of acceleration and spin. Thus, the present invention device may be used to test a projectile or to recreate an event, such as an assault or murder.

Figure 3:
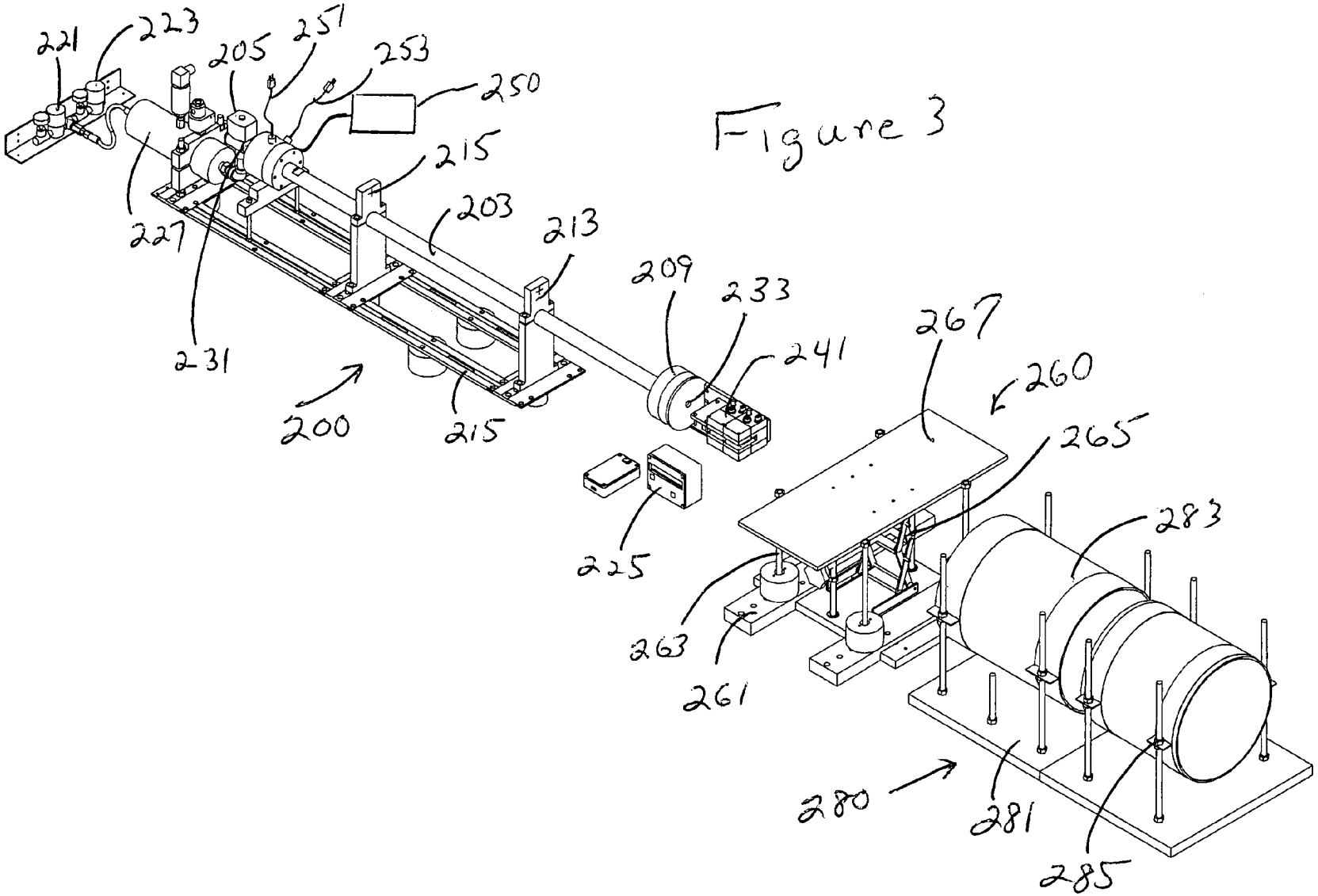
FIG. 3 shows present invention device of FIG. 2, but with a target support member and a bullet trap.

FIG. 3 shows device 200 as shown in FIG. 2, but with two differences. First, the wiring for microprocessor 225 is not shown. Second, additional components are shown. Thus, adjustable height target support means 260 is illustrated, along with bullet trap 280.

Adjustable height target support means 260 has a flat surface 267 supported by four vertical guides, such as guide 263 mounted on base 261. Scissors support 265 is also included. Base 261 is weighted or otherwise bolted or attached to an immovable object such as a heavy table or floor. Flat surface 267 may be height adjusted so that a taller or shorter target may be attached thereto so as to align a desired entry point with the trajectory path of the projectile.

Bullet trap 280 includes one or more drums 283 that contain layers of non-damaging stopping/trapping materials, such as plastics, foam, weaves, sand, etc. One or more drums 283 are mounted on adjustment rods such as rod 285 and bullet trap 280 is strategically positioned to accommodate a desired trajectory.

Figure 4:
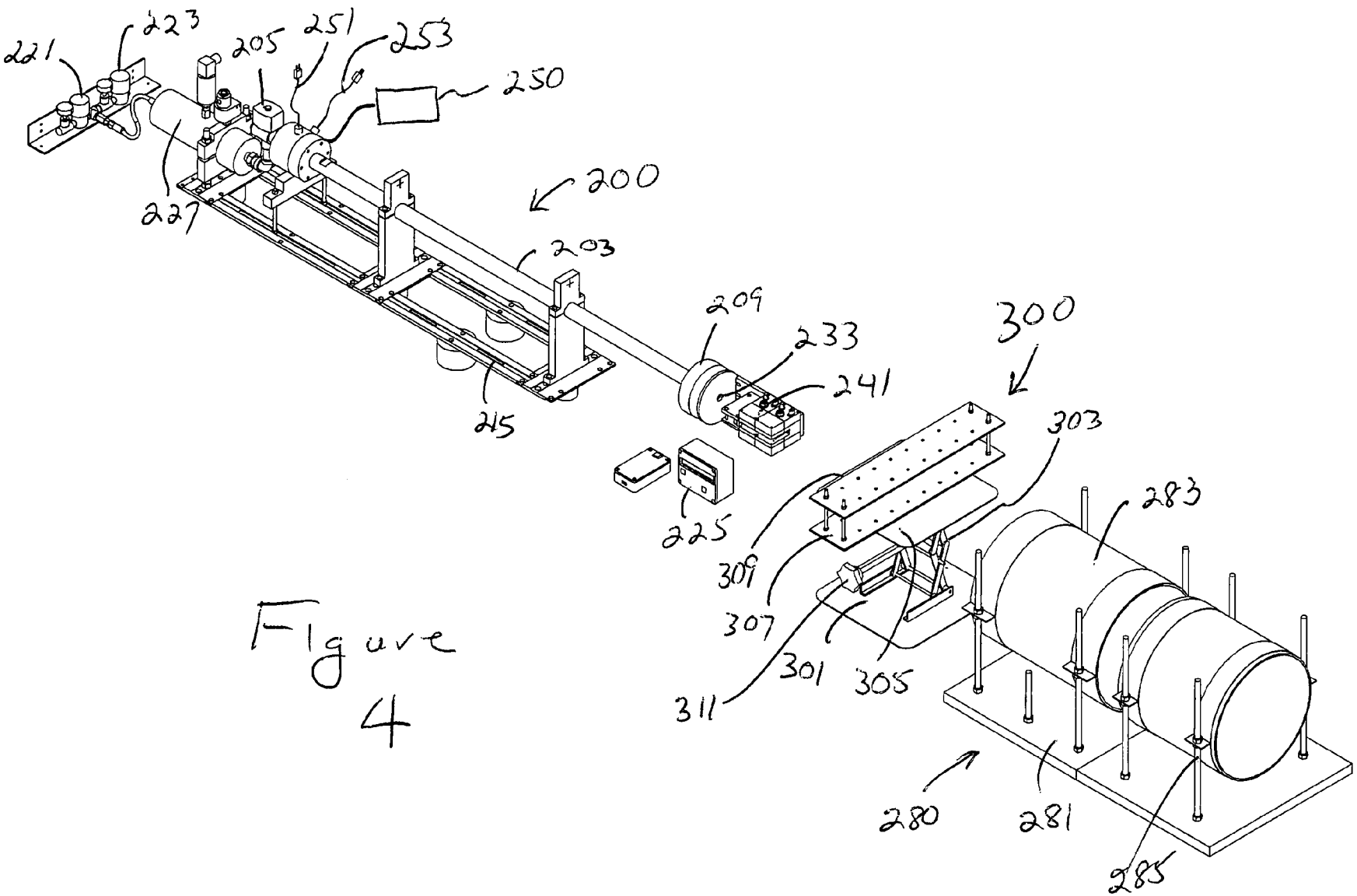
FIG. 4 illustrates the present invention device and bullet trap of FIG. 3 but with a different target support means.

FIG. 4 shows the same present invention device 200 as shown in FIGS. 2 and 3 and also includes the bullet trap of 280 of FIG. 3. However, in this embodiment, alternative support means 300 has replaced support means 260 of FIG. 3. Support means 300 has a base 301, scissors height adjustment member 303, table 305, and sandwiching plates 307 and 309, the latter for sandwiching a target such as simulated or animal carcass. Height adjustment is achieved by rotation of knob 311.

Figure 5:
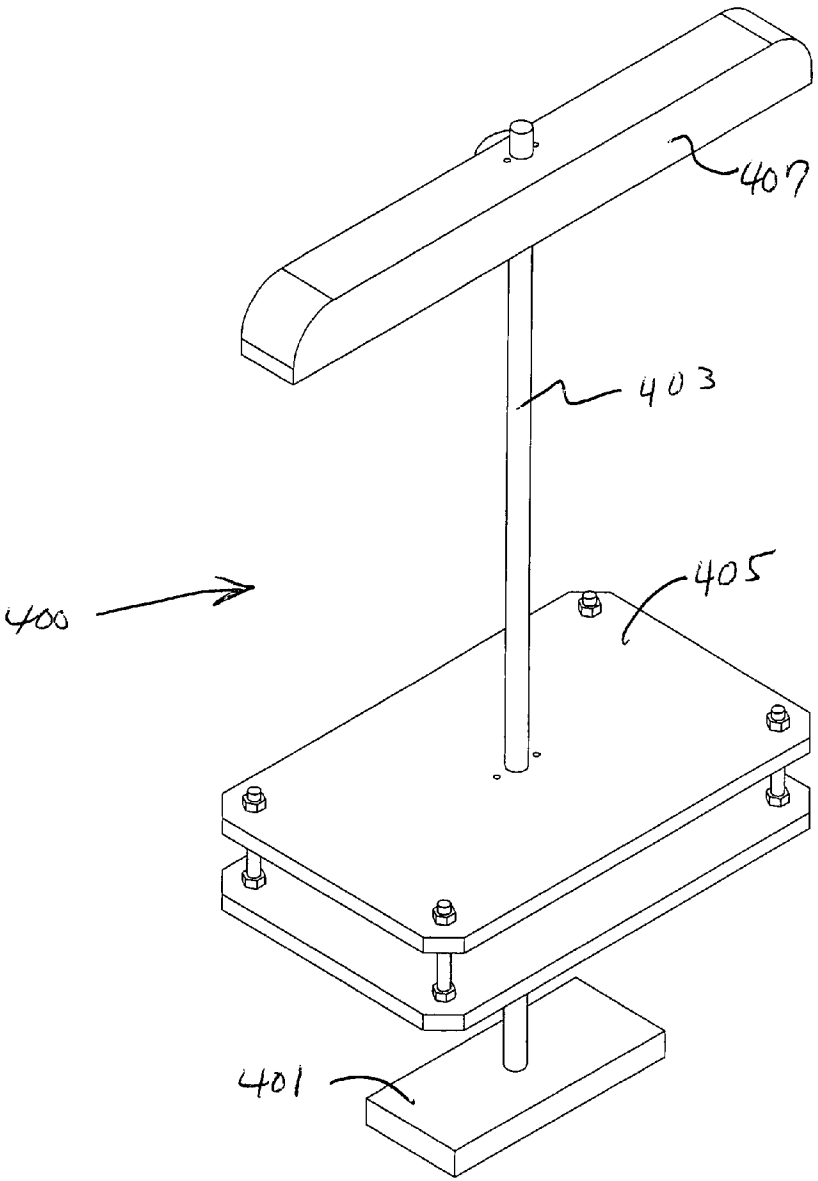
FIG. 5 illustrates yet another target support means used in conjunction with the present invention device; and, FIG. 6 illustrates a schematic diagram of the present invention.

FIG. 5 shows an oblique front view of an alternative target support means 400. It includes a base 401, an elongated vertical upright 403, an adjustable shelf 405 and a horizontal draping rack 407. This may accommodate clothing, fabric, or other draped material as a target, and may be adjusted as needed. It may be used in place of, or in addition to, the other target support means described above.

Figure 6:
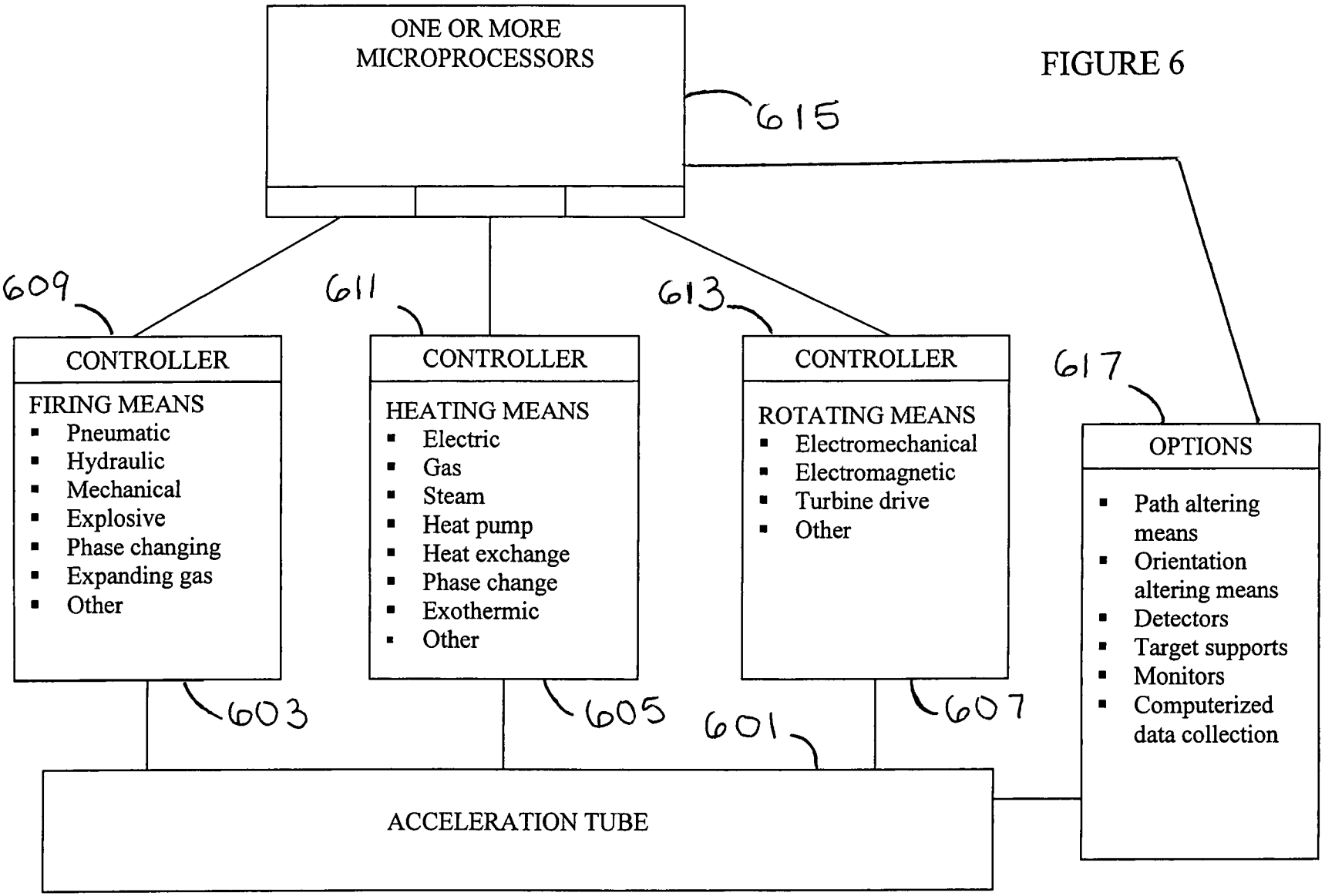

FIG. 6 shows a schematic diagram of the present invention wherein acceleration tube 601 includes firing means 603, heating means 605 and rotating means 607 with their controllers 609, 611 and 613, respectively. These are preferably controlled by one or more microprocessors 615, details of which are described above. Options 617 are also included.

Obviously, numerous modifications and variations of the present invention are possible in light of the above teachings. It is therefore understood that within the scope of the appended claims, the invention may be practiced otherwise than as specifically described herein.

What is claimed is:

1. A multi-variable, multi-parameter projectile launching and testing device which comprises;

a.) an elongated hollow acceleration tube having a firing end and an exit end;

b.) firing means functionally connected to said firing end of said elongated acceleration tube, said firing means including a force-producing mechanism to create sufficient force to accelerate a projectile through said elongated acceleration tube;

c.) heating means functionally connected to at least a portion of said elongated acceleration tube for temperature control of a projectile;

d.) rotation means functionally connected to said elongated acceleration tube for rotating said acceleration tube;

e.) first control means for variable control of said firing means;

f.) second control means for variable control of said heating means; and, g.) third control means for variable control of said rotation means; and, h.) at least one microprocessor, and said first control means, said second control means, and said third control means are microprocessor controlled with said microprocessor;

wherein a user may accelerate a projectile through said elongated acceleration tube with a pre-selected force, at a pre-selected temperature and with a pre-selected rate of rotation using said first control means, said second control means and said third control means.

2. A multi-variable, multi-parameter projectile acceleration and testing device of claim 1 which further comprises:

i.) orientation altering means for changing orientation of a projectile accelerated form said elongated acceleration tube.

3. A multi-variable, multi-parameter projectile acceleration and testing device of claim 1 wherein said firing means includes an explosive firing mechanism.

4. A multi-variable, multi-parameter projectile acceleration and testing device of claim 1 wherein said microprocessor includes programmable software that will enable a user to pre-program said first control means, said second control means and said third control means.

5. A multi-variable, multi-parameter projectile acceleration and testing device of claim 4 wherein there is a single microprocessor connected to said first control means, to said second control means, and to said third control means.

6. A multi-variable, multi-parameter projectile acceleration and testing device of claim 1 which further includes path altering means for changing a trajectory path of a projectile acceleration from said elongated acceleration tube.

7. A multi-variable, multi-parameter projectile acceleration and testing device of claim 1 further including a target support means that includes an adjustable height mechanism and a target holding mechanism.

8. A multi-variable, multi-parameter projectile acceleration and testing device of claim 7 wherein said target support means includes a target hanger for hanging a fabric or other flexible material.

9. A multi-variable, multi-parameter projectile acceleration and testing device of claim 1 wherein said heating means is selected from the group consisting of electric, gas, steam, heat pump, heat exchange, phase change or exothermic heating systems.

10. A multi-variable, multi-parameter projectile acceleration and testing device of claim 1 which further includes a bullet trap.

* * * * *